US006039678A

United States Patent [19]

Dawson

[11] Patent Number: 6,039,678

[45] Date of Patent: Mar. 21, 2000

[54] DUMBBELL SET WITH QUICK RELEASE PLATES

[76] Inventor: Fredric O. Dawson, 1719 Grant St., Santa Clara, Calif. 95050

[21] Appl. No.: 09/184,556

[22] Filed: Nov. 2, 1998

[51] Int. Cl.[7] ..... A63B 21/075

[52] U.S. Cl. ..... 482/107; 482/104; 482/108

[58] Field of Search ..... 482/104, 106, 482/107, 108

[56] References Cited

U.S. PATENT DOCUMENTS

| | | | |
|---|---|---|---|
| 1,672,944 | 6/1928 | Jowett | 482/108 |
| 1,991,520 | 2/1935 | Postl | 482/108 |
| 3,825,253 | 7/1974 | Speyer | 482/106 |
| 4,861,025 | 8/1989 | Rockwell | 482/104 |
| 5,839,997 | 11/1998 | Roth et al. | 482/107 |

FOREIGN PATENT DOCUMENTS

| | | | |
|---|---|---|---|
| 524174 | 8/1921 | France | 482/108 |

OTHER PUBLICATIONS

Bodybuilder's Discount Outlet Summer 1995 Catalog p. 20. Showing Power Block Selectorized Dumbbells & Stand, 1994.

*Primary Examiner*—J. Mulcahy
*Attorney, Agent, or Firm*—Robert Samuel Smith

[57] ABSTRACT

A dumbbell system including at least one dumbbell having a handle bar being a tube with an internal thread with a stop plate abutting each end of the handle bar. Each stop plate has a central aperture such that the interior passage of said tube opens up through each stop plate. A threaded shaft screws into each end of the tube through the respective stop plate. Weight plates, each having a slot are stacked onto the threaded shaft and when the threaded shaft is screwed into the tube, the knob end of the shaft tightens the weight stack against the stop plate. A rack is provided for storing the weight plates and facilitating removal and mounting weight plates

6 Claims, 2 Drawing Sheets

DUMBBELL SET WITH QUICK RELEASE PLATES

FIELD OF THE INVENTION

This invention relates to dumbbells and particularly to a set of dumbbells that feature quick removal of addition of plates for changing the weight of the dumbbell as required for performing a variety of exercises.

PRIOR ART AND INFORMATION DISCLOSURE

A dumbbell set is a pair of weights, each hand holding one of the dumbbells, with which various exercises are performed such as curls, over head presses, bench presses, flies and just about every motion that can be performed holding the weights and moving the arms. The original dumbbell, in use before the end of the nineteenth century, was simply a bar, about six inches long, with a metal ball secured on each end. The handle and two balls comprised an integral casting.

After the turn of the century, dumbbells came into use consisting of a bar about twelve inches long to which were secured plates (weights) and collars for securing the plates. According to this arrangement, each bar had one pair of collars, centrally located on the bar and spaced from one another to permit grasping the center of the bar with one hand, with replaceable weights located on both ends of the bar and two retaining collars, one on each end of the bar for securing the weights on the bar. The weights are typically steel plates (discs) having a central aperture through which the handle is inserted. The weight is selected by securing plates of any one selected diameter and thickness and by selecting a corresponding number of plates.

For safety sake, it is very important that the collars be secured very reliably to the bar. This is because exercises with dumbbells typically involve swinging the dumbbells in a manner that the plates could fly off the handle in an unpredictable direction if the retaining collars become separated during the course of the exercise.

For many years, the retaining collars have typically been a metal ring that slides onto the end of the bar with a setbolt threaded radially into the ring that abuts against the handle bar of the dumbbell. A wrench is used to loosen/tighten the set bolt when it is required to replace the plates. This arrangement is not entirely reliable. The setbolts occasionally loosen regardless of the effort to tighten the setbolt. At the least, this causes an annoying interruption of the exercise. Another persistent annoyance is that the weights are generally changed with each different exercise. This requirement involves loosening (unscrewing) the setbolt of the two retaining collars on each bar and removing the outer collars, adding or removing the required disk to each end of the bar, repositioning the two retaining collars on each bar and retightening the respective set bolts.

Another problem with this arrangement is the difficulty in temporarily storing the plates that are not in immediate use. The numerous plates required for a complete repertoire of exercises tend to become scattered when not in use and this poses an additional interruption of the exercise routine.

SUMMARY OF THE INVENTION

It is an object of this invention to provide a dumbbell set which enables the user to change plates with greater speed and convenience than is provided by the systems of the prior art.

It is another object that the means for mounting the various plates on the dumbbell handle be more secure than the use of setbolts relied upon by the dumbbells of the prior art.

It is another object to provide a stand designed to accommodate the plates and dumbbells of this invention that facilitate changing the plates and provide a convenient storage for plates that are not in immediate use.

This invention is directed toward a dumbbell set comprising a handle being a tube, about six inches long and having an interior thread. A pair of square "stop" plates are permanently secured to the tube, one "stop" plate abutting each end of the bar. Each; "stop" plate has a centrally located aperture so that the opening at each end of the tube opens out through the respective "stop" plate. A retaining cap for each end of the tube is provided wherein each retaining cap is a knob (disk having a size adapted for manually grasping) with a threaded shaft having one end concentrically abutting the center of the knob. The "weight" plates to be added as dumbbell weights are square plates with a slot extending from an outer edge to the center of the "weight" plate. Each "weight" plate is mounted on the shaft between knob and the "stop" plate and by secured by turning the knob so as to force the stack of weight plates against the stop plate. The construction of the weight plates, each having the slot, provides for mounting the plate onto the shaft by simply loosening the knob straddling the weight plate onto the shaft then retightening the knob.

A rack stand, which is an embodiment of this invention, is provided which both facilitates storing the weight plates and positions the dumbbells for changing the weight plates.

DESCRIPTION OF PREFERRED EMBODIMENTS

Figure 3:
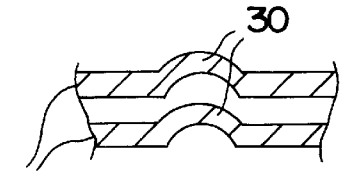
FIG. 3 shows a pair of dumbbells on the rack stand of this invention.
Figure 1:
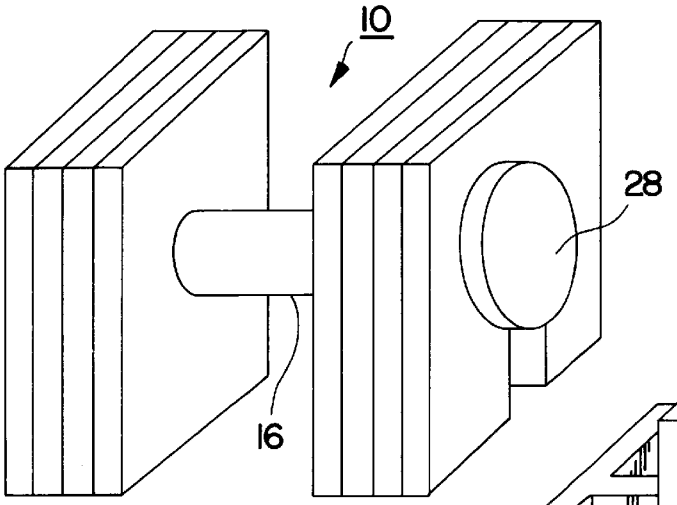
FIG. 1 shows the assembled dumbbells of this invention.
Figure 2:
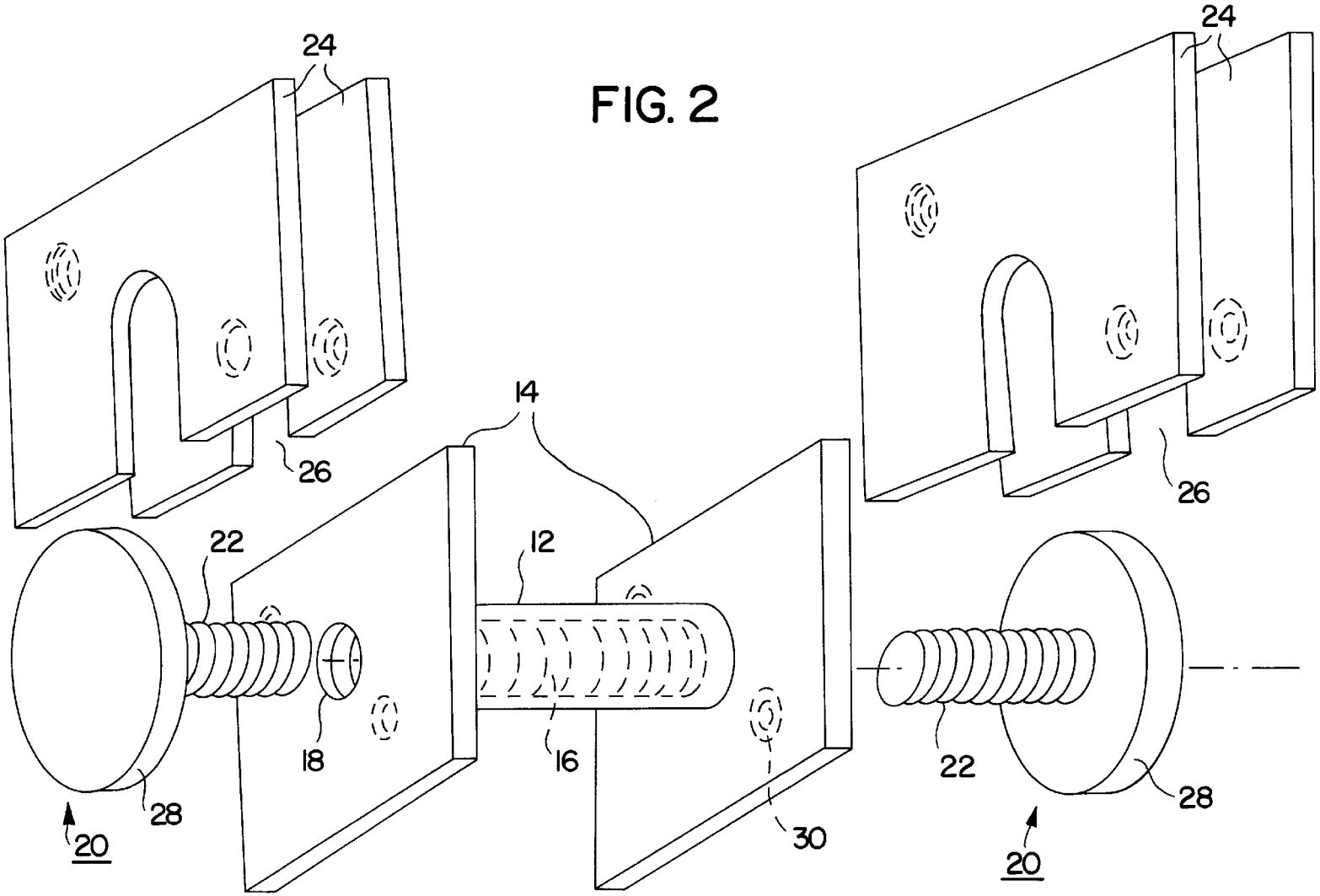
FIG. 2 is an exploded view of the dumbbell of FIG. 1.

Turning now to a discussion of the drawings, FIG. 1 shows a dumbbell 10 of this invention and FIG. 2 is an exploded view of FIG. 1. The dumbbell includes a handle section being a tube 12 having an interior thread 16 and two stop plates 14, one stop plate 14 on one end opposite a stop plate 14 of tube 12 opposite the other stop plate 14 on the other end of tube 12. Each stop plate 14 has an aperture 18 providing that the threaded shaft 22 of a cap 20 can be screwed into each end of the tube 12. Four weight plates 24 are shown each having a slot 26 providing that the weight plates are mountable on the dumbbell with the shaft 22 inserted through the slot. 26. The weight plates are secured by turning knobs 28 so that weight plates are seized between stop plates 14 and knobs 28. Each weight plate 24 and stop plate 14 has a pair of dimples 30. The dimple 30 of each plate 24 engages the a dimple of a neighboring weight plate 14 or stop plate 14 so that, when the knob 28 is tightened against the stack of weight plates, the stack of weight plates and stop plates are fixed relative to one another. FIG. 3 is a sectional view showing, in greater detail, the dimple of one plate 24 poised for engaging the dimple of a neighboring plate 24.

Figure 4:
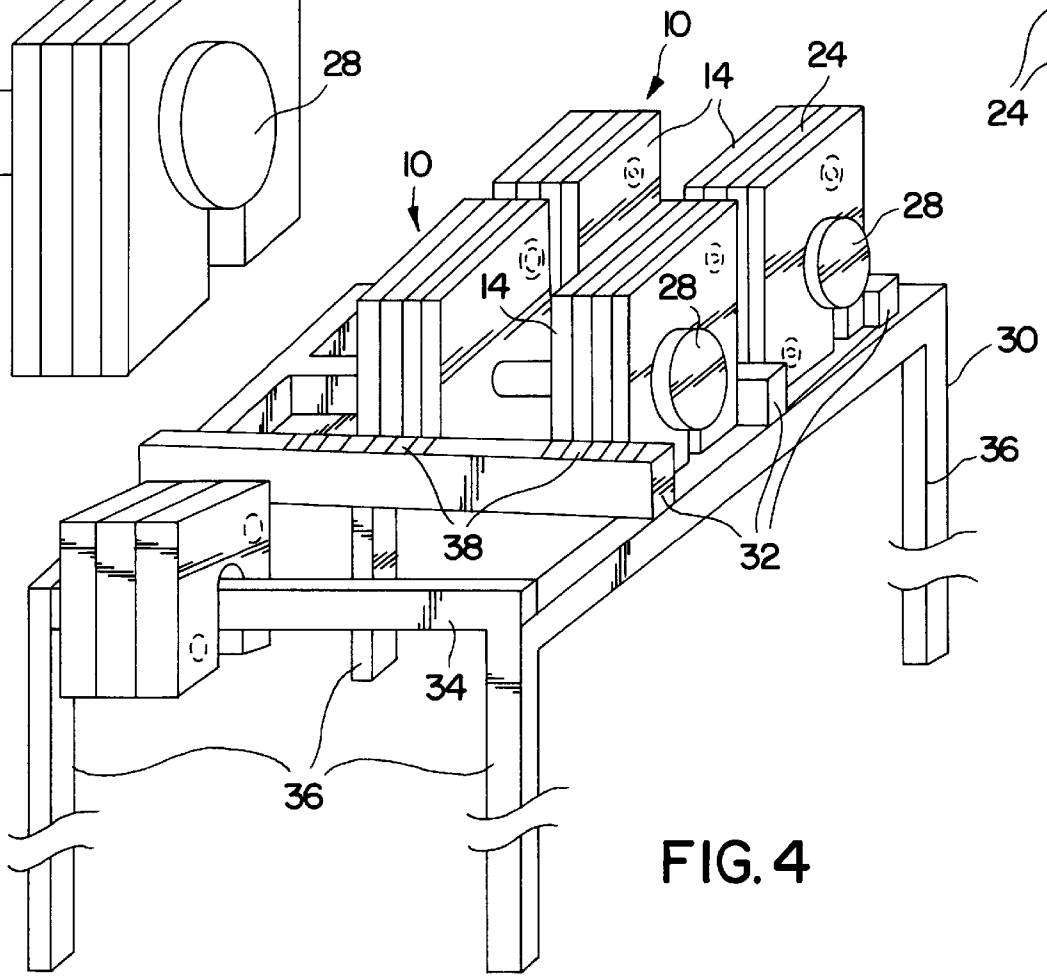
FIG. 4 is a sectional view of dimples in the weight plates for locking the weight plates.

FIG. 4 shows two dumbbells 10 positioned on a stand 30 of this invention which is designed for convenient changing weight plates. The dumbbells are positioned in a trough between members 32 . A scale 38 on each cross member indicates the weight of the dumbbell. Each knob 28 is turned to separate the knob from the stop plate 14 so that weight plates 24 may be added or withdrawn from the dumbbell 10. A rack bar 34 is provided for temporarily storing spare weight plates. The stand has four legs 36.

There has been described a dumbbell 10 that offers great convenience for changing weights simply by turning a knob and inserting or withdrawing weights from the dumbbell then retightening the knob. The weight plate with a slot provides that, in adding a weight plate to the dumbbell, the user need only unscrew the shaft sufficiently to slide the shaft into the slot of the weight plate then retighten the shaft on the dumbbell handle. This quick change feature is very attractive to the typical user. The rack facilitates loading, unloading weight plates on the handle and is very convenient for storing the weight plates which otherwise become scattered around the weight room.

Variations and modifications of this invention may be suggested by reading the specification and studying the drawings which are within the scope of the invention.

For example, the stop plates may be substituted by stop members which, in one design, are collars.

The weight plates may have a shape other than square.

In FIG. 4, the dumbbells may be used independent of the rack 30 or the outside alignment bars eleminated from the rack 30 leaving only the central alignment bar 32A with indicia for alignment. The scale indicating number of weight plates may be on the top surface 33 of the stand.

I therefore wish to define the scope of the invention by the appended claims.

I claim:

1. A dumbbell system which comprises:

a tube having an internal thread;

a pair of stop plates, one of said stop plates perpendicularly abutting one end of said tube opposite said other end plate perpendicularly abutting another end of said tube;

each said top plate having an aperture concentric with an opening at an end of said tube;

a pair of threaded shafts, each having a knob on one end and dimensioned to screw into said end of said tube through said stop plate;

a plurality of identical weight plates, each weight plate having an aperture dimensioned to provide that each said shaft is insertable through said aperture of said each weight plate and screwable into an end of said tube opposite said threaded shaft screwed into an opposite end of said tube providing that said weight plate be securely mountable onto said shaft by tightening said knob against said weight plate toward said respective stop plate;

each said weight plate having a straight section of an edge and said aperture in each said weight plate being centrally located;

a straight slot in each said weight plate extending perpendicularly from said straight section of said edge of said weight plate to said aperture;

at least one dimple on each weight plate forming a concavity on one side of said weight plate and a convexity on an opposite side of said weight plate arranged so that the slots of adjacent weight plates are aligned when the convexity on one plate engages the concavity on an adjacent plate;

said dimple, aperture and slot in each said plate operable arranged in combination with one another and dimensioned to permit supporting said dumbbell system on a flat surface with said straight section of each plate against said flat surface whereby said slot of each weight plate is aligned with said slot of a neighboring weight plate and said dimple of each weight plate engages said dimple of a neighboring weight plate and further permitting that an additional weight plate is mountable on said dumbbell system by inserting said shaft through said slot into said aperture of said additional weight plate whereby said at least one dimple of said additional weight plate is aligned with a dimple of one of a neighboring weight plate and said stop plate.

2. The dumbbell system of claim 1 wherein said knob is a disk, dimensioned for convenient grasping with said disk having an end securely perpendicularly concentrically abutting an end of said shaft.

3. The dumbbell system of claim 1 wherein each said weight plates is substantially square and said aperture in each said weight plate is centrally located in said square.

4. The dumbbell system of claim 1 which further comprises a rack for storing said plurality of weight plates and for facilitating mounting and withdrawing said plurality of weight plates onto and from said shaft.

5. The dumbbell system of claim 4 wherein said rack comprises:

a stand having a plurality of legs for supporting said stand;

a rack bar mounted on said stand and operably arranged for engaging said slots of each said weight plate;

at least one elongated cross bar (32) extending across a top surface of said stand providing that said dumbells may be positioned on said surface against said cross bar to facilitate adding and withdrawing at least one of said weight plates on said dumbbells.

6. The dumbell system of claim 5 which comprises a scale on one of said top surface of said stand and said at least one cross bar operably arranged to indicate a number of plates mounted on said dumbbells when said dumbbells are positioned on said to surface adjacent said scale.

* * * * *